US010989431B2

(12) United States Patent
Mikulica et al.

(10) Patent No.: US 10,989,431 B2
(45) Date of Patent: Apr. 27, 2021

(54) ACTUATOR SLIPPAGE SENSOR

(71) Applicant: Honeywell International Inc., Morris Plains, NJ (US)

(72) Inventors: Miroslav Mikulica, Brno (CZ); Ondrej Ficner, Bucovice (CZ); Ivo Chromy, Rajhrad (CZ)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 204 days.

(21) Appl. No.: 16/215,944

(22) Filed: Dec. 11, 2018

(65) Prior Publication Data

US 2020/0182504 A1 Jun. 11, 2020

(51) Int. Cl.

| | |
|---|---|
| ***F24F 11/00*** | (2018.01) |
| ***F24F 11/89*** | (2018.01) |
| ***F24F 11/74*** | (2018.01) |
| ***F24F 13/14*** | (2006.01) |

(52) U.S. Cl.

CPC ..... *F24F 11/74* (2018.01); *F24F 11/89* (2018.01); *F24F 13/1426* (2013.01)

(58) Field of Classification Search

CPC ..... F24F 2013/1433; F24F 2013/1426; F24F 11/89; F24F 11/70; F24F 11/00; F24F 11/0001; F24F 11/38

USPC ..... 318/466–467; 454/239, 256

See application file for complete search history.

(56) References Cited

U.S. PATENT DOCUMENTS

| | | | | |
|---|---|---|---|---|
| 6,198,243 | B1 | 3/2001 | Ritmanich et al. | |
| 7,285,147 | B2 * | 10/2007 | Kuo | B01D 46/0023 116/268 |
| 2006/0048525 | A1 | 3/2006 | Cook | |
| 2009/0053989 | A1 * | 2/2009 | Lunde | A61L 9/00 454/187 |
| 2013/0049644 | A1 * | 2/2013 | Neumann | F24F 13/1426 318/15 |
| 2016/0116177 | A1 | 4/2016 | Sikora et al. | |
| 2016/0285301 | A1 * | 9/2016 | Kim | H02J 7/0044 |
| 2017/0164413 | A1 * | 6/2017 | Bernsen | H04W 4/80 |

* cited by examiner

*Primary Examiner* — Vivek K Shirsat
*Assistant Examiner* — Ko-Wei Lin
(74) *Attorney, Agent, or Firm* — Seager, Tufte & Wickhem, LLP

(57) ABSTRACT

An actuator is designed to control airflow in HVAC systems by opening and closing a damper. A slippage detector may be secured to a damper shaft to measure movement of the damper shaft. This measured movement may be compared to the expected movement of the damper shaft as indicated by the movement of a rotatable output of the actuator.

20 Claims, 13 Drawing Sheets

ACTUATOR SLIPPAGE SENSOR

TECHNICAL FIELD

The present disclosure pertains generally to Heating, Ventilation, and/or Air Conditioning (HVAC) systems, and more particularly to HVAC systems using actuators to open and close dampers in order to control fluid flow.

BACKGROUND

Heating, Ventilation, and/or Air Conditioning (HVAC) systems are often used to control the comfort level within a building or other structure. In some cases, HVAC systems include dampers within air ducts to control relative air flow through the air ducts. The dampers can be actuated between a closed position in which air flow through a particular air duct is restricted and an open position in which air flow through the particular duct is not restricted or is less restricted. Dampers are driven between the closed position and the open position via actuators that employ a motor to drive an output that engages a damper shaft in order to move the damper. In some cases, the damper shaft can slip relative to the output of the actuator. Improvements in the hardware, user experience, and functionality of damper actuators, including detecting such slippage, would be desirable.

SUMMARY

The disclosure is directed to building component actuators such as damper actuators and water valve actuators that include or otherwise utilize a slippage detector to inform the actuator when there is a mismatch between rotation of the actuator output and the corresponding rotation of the damper or water valve shaft. In a particular example of the disclosure, a slippage detector detects a slippage between a rotatable output of an actuator and a rotatable input shaft of a building component. The slippage detector may include a body that houses a motion sensor, a transmitter and electronics. A securement may be configured to secure the body of the slippage detector to a rotatable input shaft of a building component so that, once secured, the body of the slippage detector rotates with the rotatable input shaft of the building component. A motion sensor may be configured to detect rotation of the body, and thus rotation of the rotatable input shaft of the building component, when the body of the slippage detector is secured to the rotatable input shaft of the building component via the securement. Electronics may be operatively coupled to the motion sensor for receiving a motion sensor output signal from the motion sensor that is representative of rotation of the body, and a transmitter may be operatively coupled to the electronics for transmitting an output signal that is representative of rotation of the body.

In another example of the disclosure, an actuatable building control component includes an actuatable building control component that may include a rotatable input shaft. An actuator may have a rotatable output that may be removably coupled to the rotatable input shaft of the actuatable building control component via a connection that can experience slippage between the rotatable output and the rotatable input shaft of the actuatable building control component. The actuator may be configured to rotate the rotatable output of the actuator on command to rotate the rotatable input shaft of the actuatable building control component through the connection. A slippage detector may be removably fixed to the rotatable input shaft of the actuatable building control component. The slippage detector may be configured to send information regarding a detected rotation of the slippage detector and thus rotation of the rotatable input shaft of the actuatable building control component to a receiver of the actuator.

In yet another example of the disclosure, a method for detecting a slippage in a connection between a rotatable output of an actuator and a rotatable input shaft of an actuatable building control component may include sensing a rotation of the rotatable input shaft of the actuatable building control component via a slippage detector that may be mounted to the rotatable input shaft of the actuatable building control component. The sensed rotation of the rotatable input shaft of the actuatable building control component may be transmitted to the actuator. The sensed rotation of the rotatable input shaft of the actuatable building control component may be compared to the rotation of the rotatable output of the actuator, and an alert may be provided when the sensed rotation of the rotatable input shaft of the actuatable building control component deviates from the rotation of the rotatable output of the actuator by a threshold amount.

BRIEF DESCRIPTION OF THE DRAWINGS

The disclosure may be more completely understood in consideration of the following description of various illustrative embodiments of the disclosure in connection with the accompanying drawings, in which.

Figure 1A:
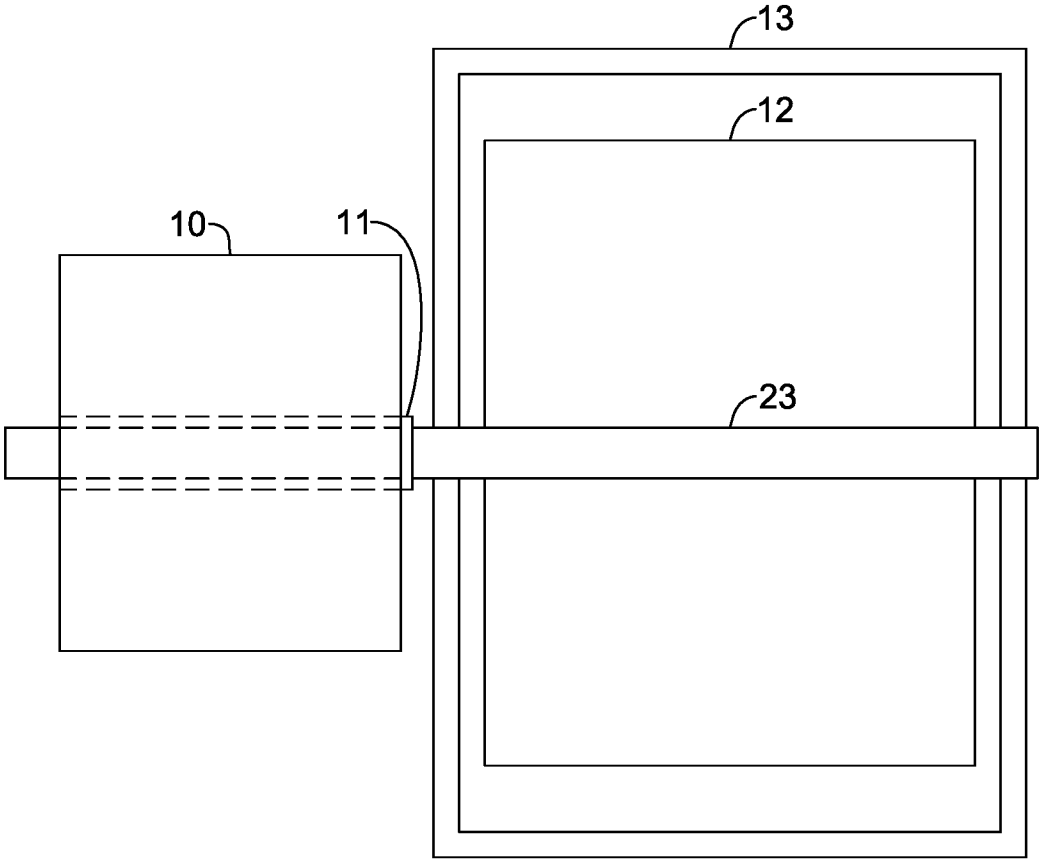
FIG. 1A is a schematic view of an actuator coupled with a damper that is shown in a partially closed position.

While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

DESCRIPTION

The following description should be read with reference to the drawings wherein like reference numerals indicate like elements. The drawings, which are not necessarily to scale, are not intended to limit the scope of the disclosure. In some of the figures, elements not believed necessary to an understanding of relationships among illustrated components may have been omitted for clarity.

All numbers are herein assumed to be modified by the term "about", unless the content clearly dictates otherwise. The recitation of numerical ranges by endpoints includes all numbers subsumed within that range (e.g., 1 to 5 includes 1, 1.5, 2, 2.75, 3, 3.80, 4, and 5).

As used in this specification and the appended claims, the singular forms "a", "an", and "the" include the plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is contemplated that the feature, structure, or characteristic may be applied to other embodiments whether or not explicitly described unless clearly stated to the contrary.

A variety of building control components include actuators for actuating the building control component between differing positions including a closed position, an open position and in some cases a number of intervening intermediate positions. A building control component may be a damper used for controlling air flow in regulating building temperature, ventilation, smoke and fire control, and the like. In some cases, a connection between the actuator and the building control component may be susceptible to slippage. In this, slippage is defined as a mismatch between how far the building control component should have rotated (as defined by rotation of a rotatable output of the actuator) and how far the building control component actually rotated. A slippage detector that is configured to detect a slippage between a rotatable output of an actuator and a rotatable input shaft of a building control component may be secured to the rotatable input shaft of the building control component. The building control component may include a damper with a rotatable damper input shaft, for example, or a water valve with a rotatable valve input shaft. These are just examples.

Figure 1B:
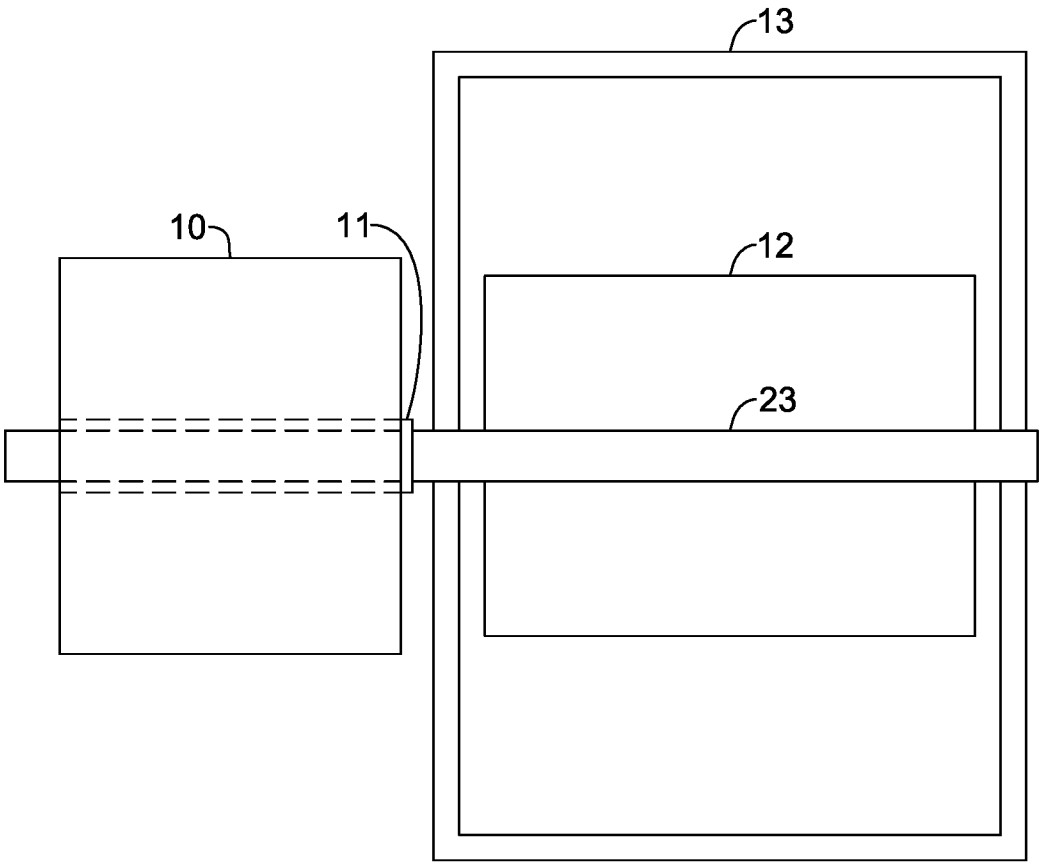
FIG. 1B is a schematic view of an actuator coupled with a damper that is shown in a partially open position.

FIG. 1A is a schematic side view of an actuator 10 that is coupled with a duct damper 12 that is shown in a partially closed position while FIG. 1B schematically shows the damper 12 in a partially open position. The damper 12 is shown disposed within a duct 13. An HVAC zone controller may be generally configured to provide instructions to move the damper 12 towards a closed position or towards an open position to regulate air flow through a duct in which the damper 12 is deployed in order to provide thermal control over a zone in response to thermostat signals. The damper 12 generally includes a rotatable or otherwise movable obstruction such as a damper blade within the duct that can be actuated between a relatively close position, as shown in FIG. 1A, and a relatively open position, as shown in FIG. 1B. In a relative open position there is relatively little resistance to air flow within the duct while in the relatively closed position, there is relatively greater resistance to air flow. The damper 12 can be actuated by any of a number of electrical, pneumatic or mechanical actuators.

As illustrated, the actuator 10 may include a rotatable output 11 that is configured to engage a rotatable damper input shaft 23 of the damper 12. In some cases, the rotatable damper input shaft 23 of the damper 12 may extend through the rotatable output 11, but this is not required in all cases. The actuator 10 may include a motor (not shown) that is configured to rotate the rotatable output 11, and thus rotate the rotatable input shaft 23 of the damper 12 in order to rotate damper 12 between various positions, including positions other than fully open or fully closed.

Figure 2:
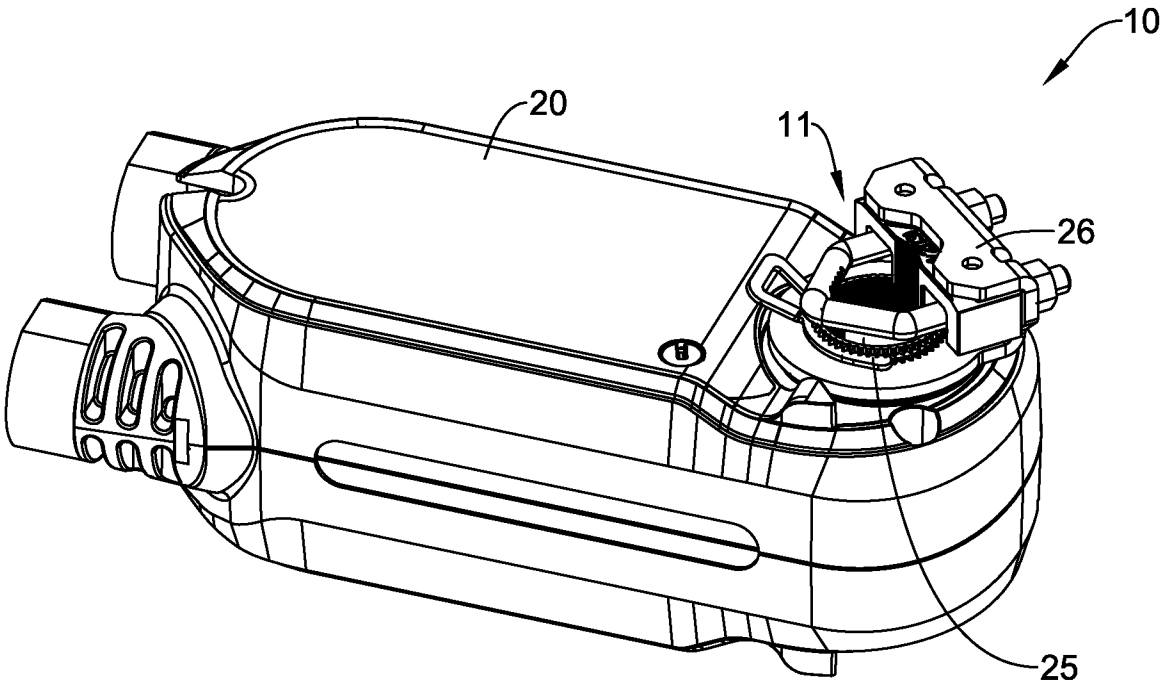
FIG. 2 is a schematic view example of an actuator with a rotatable output in accordance with the present disclosure.

FIG. 2 provides a perspective view of the actuator 10. As can be seen, the actuator 10 includes an actuator housing 20. While not expressly illustrated, the actuator 10 may include an electric motor and optionally a gear box that together can actuate or cause movement of the rotatable damper input shaft 23 when the actuator 10 is engaged with the rotatable damper input shaft 23. In some cases, as shown, the rotatable output 11 includes an aperture 25 that extends through the actuator housing 20 in order to permit the rotatable damper input shaft 23 to extend therethrough. The rotatable output 11 includes a clamp mechanism 26 that is adjustable to permit the rotatable damper input shaft 23 to be extended through, and can subsequently be tightened down to secure the rotatable damper input shaft 23 relative to the rotatable output 11 such that the rotatable damper input shaft 23 will rotate with the rotatable output 11. The rotatable output 11 may have a range of rotation between a first end position and a second end position. Further, the rotatable output shaft 11 may be configured to actuate the damper 12 within the HVAC duct 13 when the actuator 10 is operatively coupled to the damper 12 by engaging the rotatable output shaft 23 with the rotatable output 11. It will be appreciated that in some cases, there may be slippage between the rotatable damper input shaft 23 and the rotatable output 11. In some cases, the actuator 10 may communicate with a slippage detector 15 (shown in FIG. 3) that is configured to be secured to the rotatable damper input shaft 23 and to output a signal to the actuator 10 that the actuator 10 may use to compare actual movement of the rotatable damper input shaft 23 with movement of the rotatable output 11.

Figure 3:
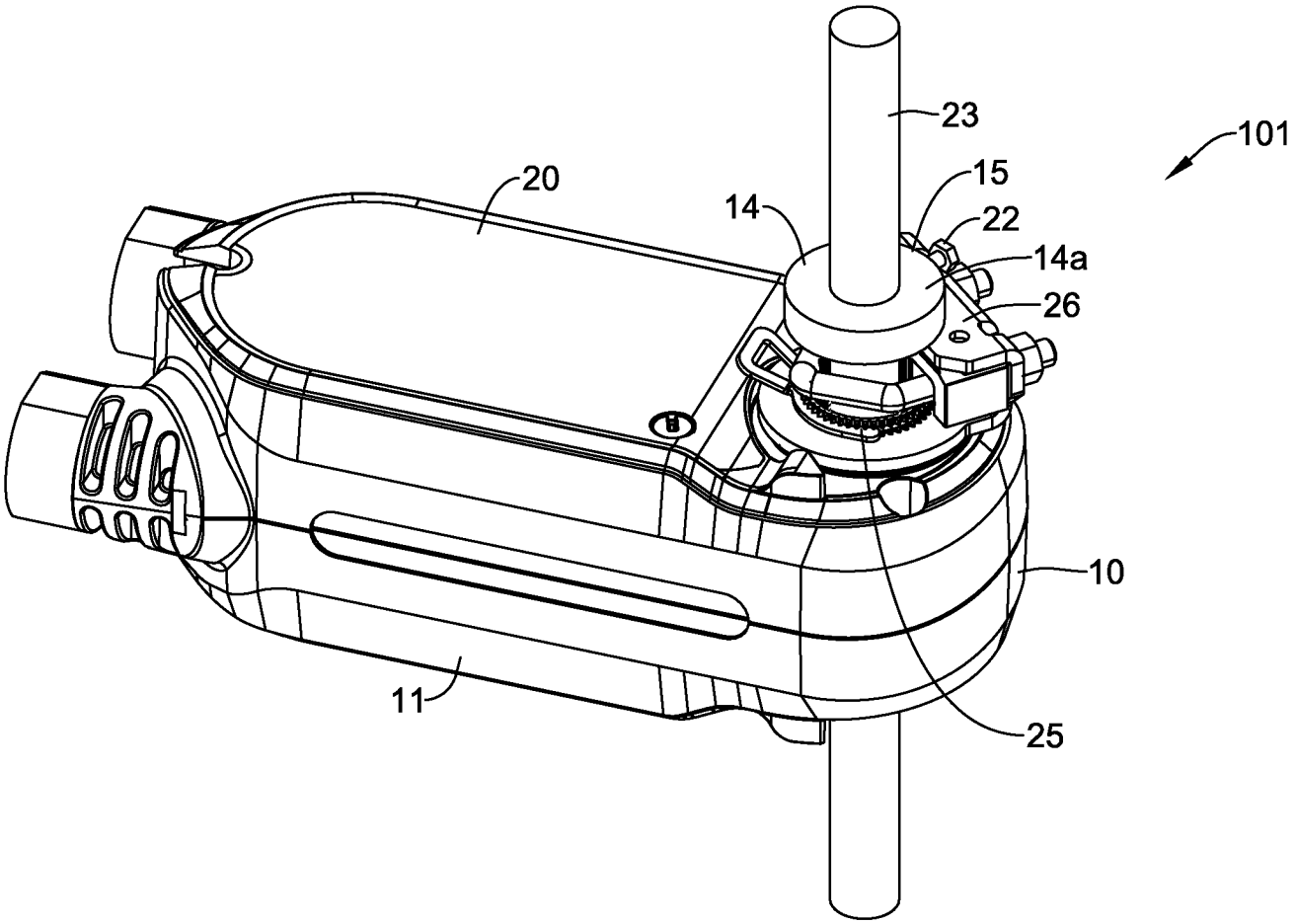
FIG. 3 is a perspective view of an actuator and a rotatable damper input shaft that includes an illustrative slippage detector secured to the rotatable damper input shaft.
Figure 5:
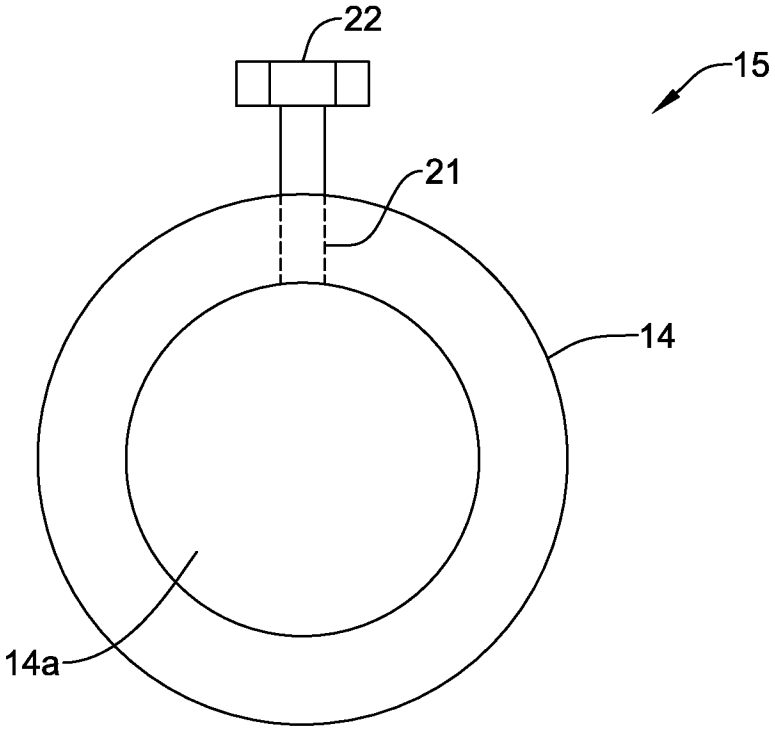
FIG. 5 is a perspective view of an illustrative slippage detector.

FIG. 3 shows an assembly 101 that includes the rotatable damper input shaft 23 engaged with and extending through the rotatable output 11 of the actuator 10. The slippage detector 15 is engaged with the rotatable damper input shaft 23 such that the slippage detector 15 is able to rotate with the rotatable damper input shaft 23 as the rotatable output 11 rotates the rotatable damper input shaft 23. The slippage detector 15 includes a body 14. In some cases, the body 14 may have an annular shape, and may define an aperture 14*a* that may be configured to accommodate the rotatable damper input shaft 23 extending therethrough. After the slippage detector 15 is positioned on the rotatable damper input shaft 23, the slippage detector 15 may be secured in place by tightening a fastener 22 that is rotatably extendable through a threaded aperture 21 that extends through the body 14 (as shown in FIG. 5). With respect to FIG. 5, it will be appreciated that the slippage detector 15 may be secured in place on the rotatable damper input shaft 23 by rotating the fastener 22 relative to the threaded aperture 21. The fastener 22 may be a screw or a bolt, for example. In some cases, the slippage detector 15 may instead be adhesively secured or even soldered into position on the rotatable damper input shaft 23.

Returning to FIG. 3, the slippage detector 15 may be mounted to the rotatable damper input shaft 23 of the building component 13 and may move with the rotatable damper input shaft 23 as the rotatable damper input shaft 23 is rotated. It will be appreciated that the actuator 10 may drive the rotatable output 11, and hence the rotatable damper input shaft 23, in a first rotational direction in order to move the damper 12 towards a more open position, and may drive the rotatable output 11, and hence the rotatable damper input shaft 23, in a second rotational directed towards a less open position. The slippage detector 15 may not be in direct physical contact with the actuator 10 or the rotatable output 11, but instead is secured to and in contact with only the rotatable damper input shaft 23. As will be discussed with respect to FIG. 6, the slippage detector 15 may contain electronics which measure movement, position and rotations about several axis and may report this information back to the actuator 10 via a wireless communications protocol.

Figure 4:
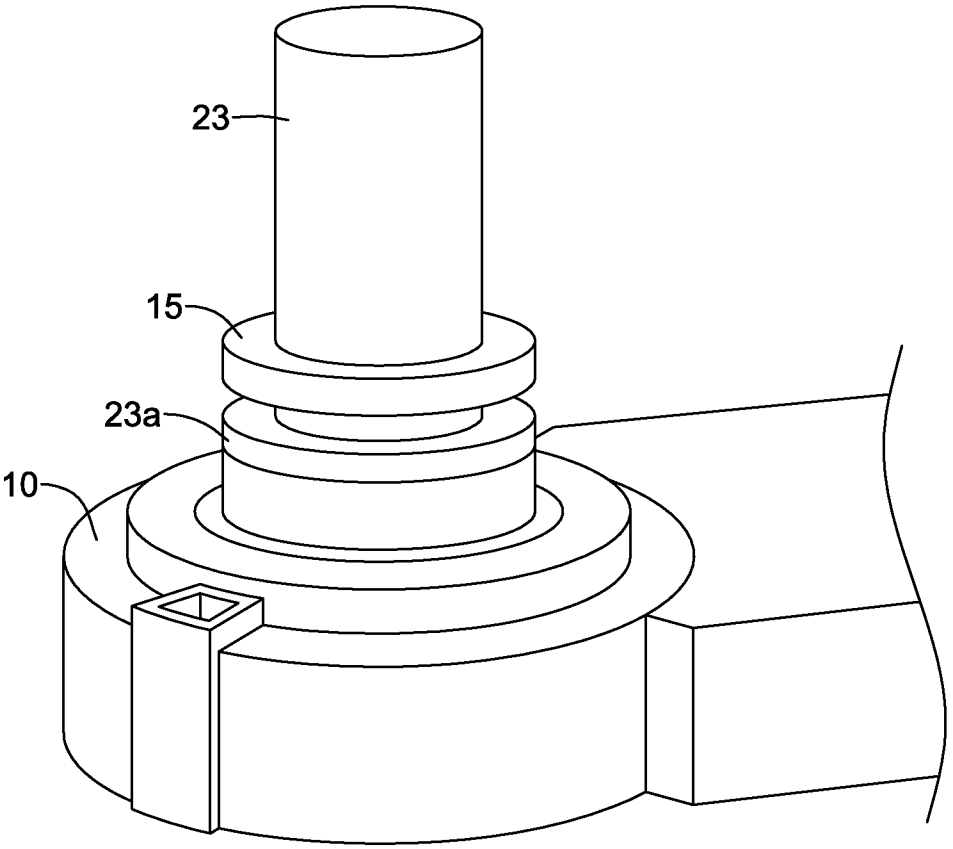
FIG. 4 is an enlarged view of a portion of the actuator of FIG. 2 in combination with the rotatable damper input shaft and illustrative slippage detector.

FIG. 4 illustrates a portion of the actuator 10, showing the slippage detector 15 positioned on the rotatable damper input shaft 23. It can be seen that in some cases, a shaft adaptor 23*a* may be used to help fit the slippage detector 15 relative to the rotatable damper input shaft 23. If used, the shaft adapter 23*a* may be a self-centering shaft adapter or a non-self-centering shaft adapter. With a non-self-centering shaft adapter, the shaft adapter 23*a* may oscillate back and forth in a direction that is orthogonal to the axis of the rotatable damper input shaft 23 as the rotatable damper input shaft 23 is rotated by the actuator by virtue of being off-center from the rotation axis of the shaft. In contrast, a self-centering shaft adapter automatically centers the shaft adapter 23*a* with respect to the rotatable valve input shaft 24 as the shaft adapter 23*a* may be secured to the rotatable damper input shaft 23. With a self-centering shaft adapter 23*a*, the shaft adapter 23*a* may remain relatively stationary relative to the rotatable damper input shaft 23*a* as the rotatable damper input shaft 23 is rotated by the actuator 10.

Figure 6A:
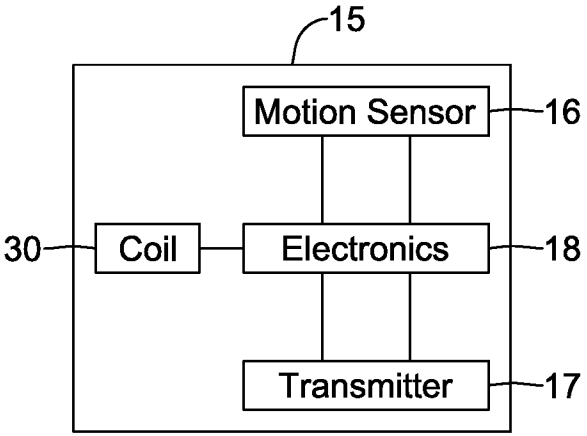
FIG. 6A is a schematic block diagram of the slippage detector of FIG. 3.
Figure 6B:
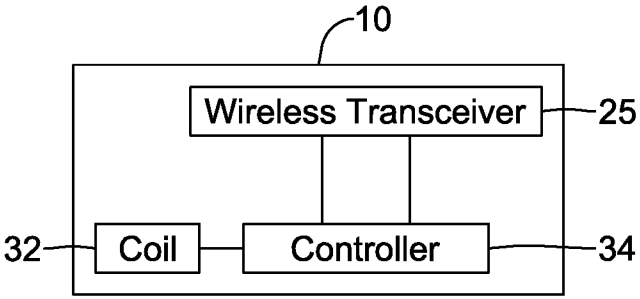
FIG. 6B is a schematic block diagram of the actuator of FIG. 2.

The slippage detector 15 may be configured to ascertain information regarding a detected rotation of the slippage detector 15 and thus rotation of the rotatable damper input shaft 23 and transmit the information to the actuator 10. FIG. 6A is a schematic view of the slippage detector 15 and FIG. 6B is a schematic view of the actuator 10. The actuator 10 may be configured to receive the information regarding the rotation of the slippage detector 15 and thus the rotation of the rotatable damper input shaft 23 and to compare the actual rotation with the expected rotation of the rotatable damper input shaft 23. A difference between the actual rotation and the expected rotation may be interpreted as slippage.

As shown in FIG. 6A, the slippage detector 15 may include a motion sensor 16, a transmitter 17, and electronics 18. The motion sensor 16 may be housed within the body 14 and may be configured to detect rotation of the body 14. If the body 14 is secured to the rotatable damper input shaft 23, then the rotation of the body 14 as detected by the motion sensor 16 is equal to the rotation of the rotatable damper input shaft 23. The motion sensor 16 may include a Micro-Electro-Mechanical System (MEMS), gyroscope, accelerometer, magnetic field sensor or such. MEMS sensors have the advantage of requiring relatively little space and electrical power, and have relatively little mass. A MEMS position sensor can readily fit onto a small enough footprint to allow the motion sensor 16 to fit into the body 14, and thus onto the rotatable damper input shaft 23. The motion sensor 16 may be a gyroscope, which may be used to sense angular displacement or movement. The motion sensor 16 may contain electronics 18 which measure movements by MEMS and position by the gyroscope or a compass. The motion sensor 16 can have wired or wireless communication and a power supply. It may also contain logic which converts signals from these sensors to the movement/position value. This measured value may then propagate to the actuator 10 via wired or wireless interface, such as a near field transmitter for supporting Near Field Communication (NFC). This device may be also powered via NFC energy transfer so it can be completely wireless, discrete and compact.

Because the slippage detector 15 rotates with the rotatable damper input shaft 23, in some cases the slippage detector 15 may be powered wirelessly. In some cases, the slippage detector 15 may include a coil 30 that is operably coupled with the electronics 18 and that may be used to provide power for powering operation of the slippage detector 15. Application of an electric field, such as by powering a coil 32 (FIG. 6B) in the actuator 10, may create an electric current in the coil 30 that may be used to power operation of the slippage detector 15. In some cases, depending on the range of motion of the rotatable output 11 of the actuator 10, there may be a wired power connection between the slippage detector 15 and the actuator 10.

In some cases, the motion sensor 16 may also include a device or a collection of devices that sense conditions, parameters, and/or events such as an environmental condition in a building. The motion sensor 16 may generate information or data related to the sensed or monitored condition. The information may be provided as an output as one or more signals that may be read by the electronics. The motion sensor 16 may be a MEMS or other sensors for sensing any condition or parameter. The motion sensor 16 may detect and communicate position information regarding the rotatable damper input shaft 23. The motion sensor 16 may be in the shape of a ring, circle or any other shape. The transmitter 17 may be operatively coupled to the electronics 18 for transmitting an output signal that is representative of rotation of the body 14. The transmitter 17 may be a wireless transmitter for transmitting an output signal that is representative of rotation of the body 14. As will be discussed with respect to FIG. 6B, the actuator 10 may include a wireless transceiver 25 for receiving information transmitted by the transmitter 17.

The electronics 18 may be operatively coupled to the motion sensor 16 for receiving a motion sensor output signal from the motion sensor 16 that is representative of rotation of the slippage detector 15, and hence rotation of the rotatable damper input shaft 23. The electronics 18 may include components such as a processing module, an electrical sensing module, a mechanical sensing module, a communications module, and/or a memory. It is contemplated that the electronics 18 may include more or less modules, depending on the application. The electronics 18 may also implement a control process algorithm specific to the motion sensor 16.

FIG. 6B is a schematic block diagram of the actuator 10. The actuator 10 includes a controller 34 that is operably coupled with the wireless transceiver 25 for receiving information related to the rotational speed and/or position of the slippage detector 14. The controller 34 may be configured to control operation of a motor (not shown) that drives rotation of the rotatable output 11 of the actuator 10. The controller 34 may also be configured to receive information as to the operation of the motor, and can derive an expected rotational speed and/or position of the rotatable output 11, and hence an expected rotational speed and/or position of the rotatable damper input shaft 23. In some cases, the controller 34 may be configured to compare the expected and actual rotational speed and/or position of the rotatable damper input shaft 23 and thus determine whether the rotatable damper input shaft 23 is slipping. If a determination is made that the rotatable damper input shaft 23 is slipping relative to the rotatable output 11, the controller 34 may send an alarm via the transceiver 25. The controller 34 may also control power to a coil 32, which may be used to wirelessly provide power to the slippage detector 15 via the coil 30.

Figure 7:
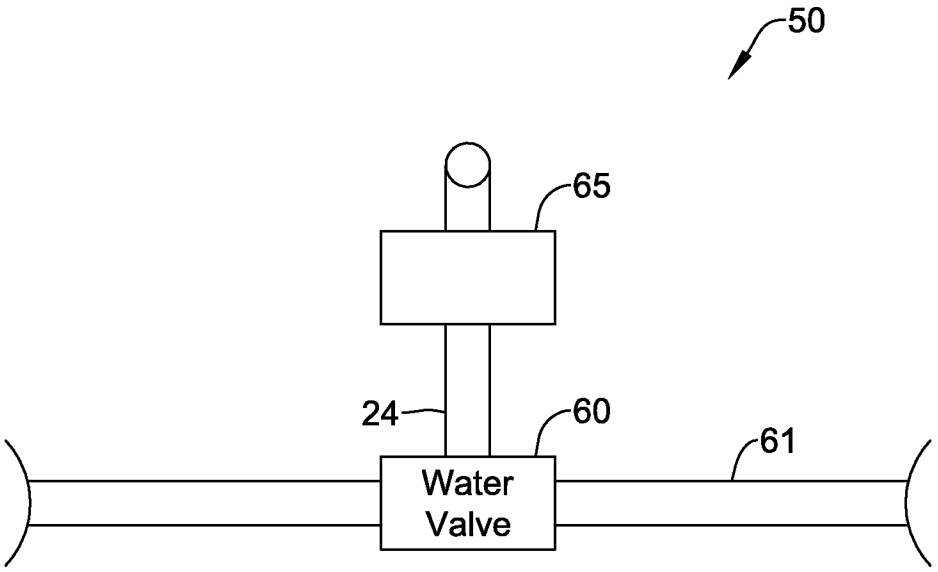
FIG. 7 is a schematic view of a water valve and water valve actuator.

Referring to FIG. 7, a water valve system 50 is shown in which a water valve actuator 65, which may be similar in operation to the actuator 10, may be used to actuate a water valve 60. In some cases, the water valve system 50 may be part of an HVAC heating system such as a hot water heating system, but this is not required in all cases. The water valve 60 has a rotatable valve input shaft 24 that may pass through an aperture formed within the water valve actuator. The water valve 60 may be connected to water pipe 61. The water valve actuator 65 may be used to rotatably engage the rotatable valve input shaft 24. It will be appreciated that in some cases, the water valve 60 may instead be a valve for fluids other than water. The water valve actuator 65 may rotate the rotatable valve input shaft 24 in a first rotational direction to open the water valve 60 and may rotate the rotatable valve input shaft 24 in a second rotational direction to close the water valve 60. The term "valve" may encompass any actuatable valve such as air dampers, water valves, gas valves, ventilation flaps, louvers, and/or other actuatable valves.

Figure 8A:
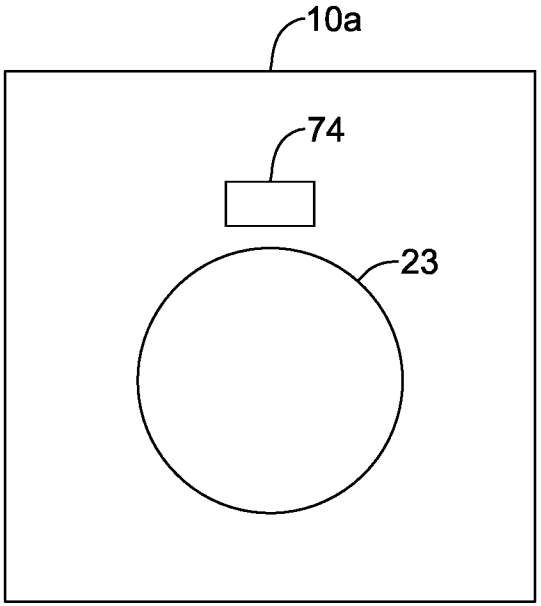
FIG. 8A is a side view of an illustrative actuator including a sensor sensitive to magnetic fields.
Figure 8B:
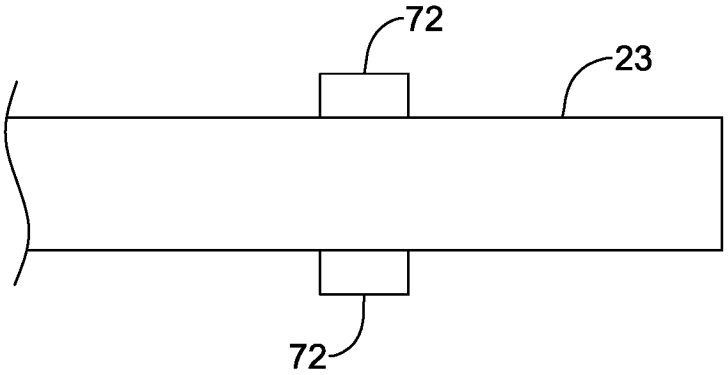
FIG. 8B is a side view of an illustrative damper actuator shaft that is configured to be coupled to the illustrative actuator of FIG. 7A that includes magnets coupled to the illustrative damper actuator shaft.
Figure 8C:
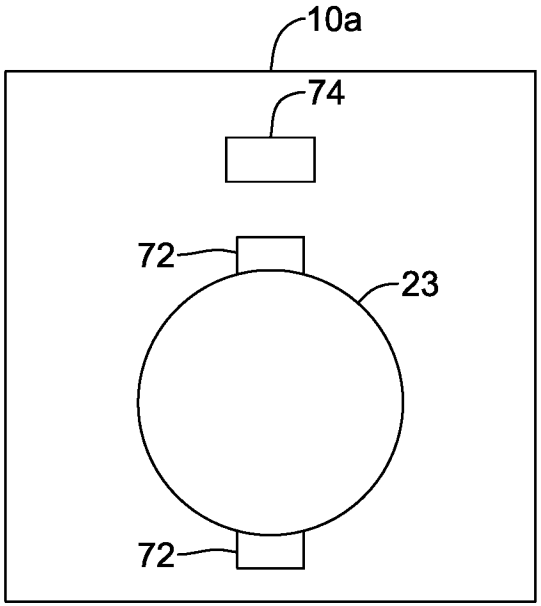
FIG. 8C is a side view of the illustrative damper actuator shaft of FIG. 8B engaged with the illustrative actuator of FIG. 7A.

FIGS. 8A-8C provide an example of detecting possible slippage without using the slippage detector 15. In simplest terms, the idea is that a sensor is secured relative to an actuator 10*a* that is configured to detect movement or the presence of something else secured relative to the rotatable damper input shaft 23. For example, a magnetic sensor 74 may be secured to the actuator 10 and one or more magnets 72 (two are shown) may be secured to the rotatable damper input shaft 23 at a position (or positions) in which the magnetic sensor 74 may detect motion of the one or more magnets 72 when the rotatable damper input shaft 23 is coupled with the actuator 10*a*. FIG. 8B shows the magnets 72 secured to the rotatable damper input shaft 23 while FIG. 8C shows the rotatable damper input shaft 23 coupled with the actuator 10*a*. As shown in FIG. 8B, by mounting a magnet 72 in a valve actuator or damper, exact position can be determined. A pulsed output signal from the magnetic sensor 74, which in some cases may be a Hall Effect sensor, is applied as an input to the electronics 18 so that the electronics 18 may detect when the rotatable valve input shaft 24 is in motion. Whenever the actuator 10*a* is powered up, the electronics may execute a routine stored within its internal memory that determines the range of movement between the fully opened and fully closed positions of the damper. The automatic ranging routine may be executed periodically (e.g. once a month) to account for slippage.

In some cases, as the rotatable damper input shaft 23, and hence the magnet or magnets 72 rotate, the south pole of the magnet (or of each magnet) may pass a sensing face of the Hall Effect sensor 74 with each revolution. The magnet or magnets 72 is(are) actuated when the South Pole approaches the Hall Effect sensor 74 and deactuated when the South Pole moves away. Thus a single digital pulse may be produced for each revolution. In lieu of a Hall Effect sensor 74, it is contemplated that a phototransistor and LED may also be utilized. It will be appreciated that the use of a magnetic sensor 74 and one or more magnets 72 means that the sensing apparatus is secured to the actuator 10*a*, and thus is stationary. In some cases, this may provide advantages in powering the apparatus for detecting slippage.

Figure 9:
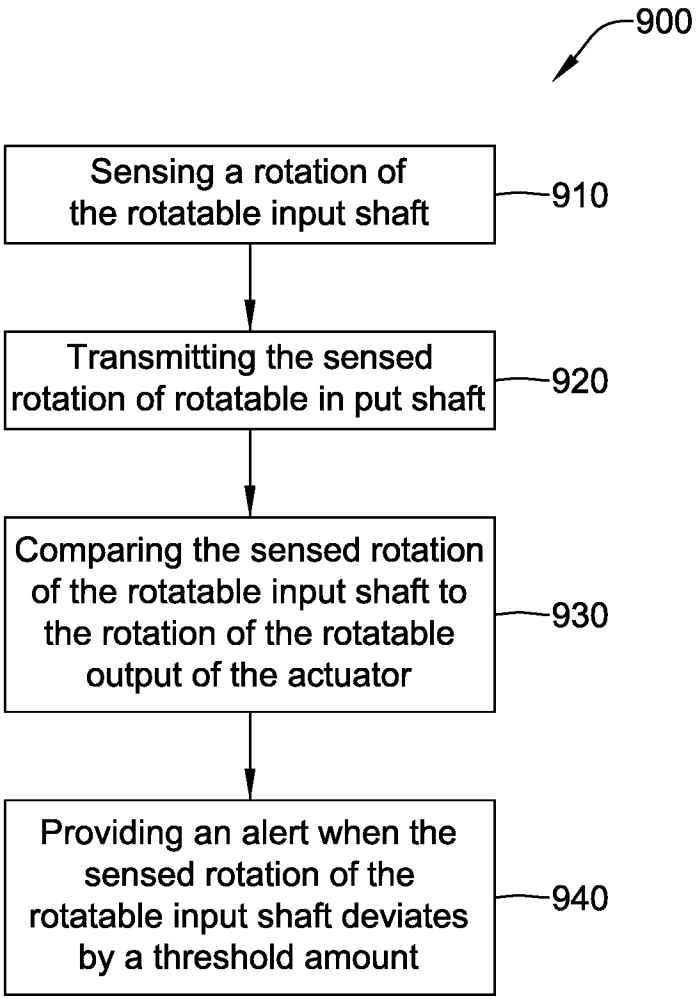
FIG. 9 is a flow diagram showing an illustrative method of detecting slippage between a rotatable output of an actuator and rotatable input shaft of an actuatable building control component.

FIG. 9 is a flow diagram showing a method 900 for detecting a slippage in the connection between a rotatable output of an actuator 10, 10*a* and a rotatable input shaft of an actuatable building control component. A rotation of the rotatable input shaft of the actuatable building control component may be sensed via a slippage detector 15. The slippage detector 15 may be mounted to the rotatable damper input shaft of the actuatable building control component, as indicated at block 910. The sensed rotation of the rotatable damper input shaft of the actuatable building component to the actuator 10, 10*a* may be transmitted, as indicated at block 920. The sensed rotation of the rotatable input shaft of the actuatable building control component and the rotation of the rotatable output of the actuator 10, 10*a* may be compared, as indicated at block 930. An alert may be provided when the sensed rotation of the rotatable input shaft of the building component deviates from the rotation of the rotatable output of the actuator 10 by a threshold amount, as indicated at block 940.

Those skilled in the art will recognize that the present disclosure may be manifested in a variety of forms other than the specific embodiments described and contemplated herein. Accordingly, departure in form and detail may be made without departing from the scope and spirit of the present disclosure as described in the appended claims.

What is claimed is:

1. A slippage detector for detecting a slippage between a rotatable output of an actuator and a rotatable input shaft of a building component, the slippage detector comprising:

a body, separate from the actuator, that houses a motion sensor, a transmitter and electronics;

a securement configured to secure the body to a rotatable input shaft of a building component so that, once secured, the body rotates with the rotatable input shaft of the building component;

the motion sensor configured to detect rotation of the body, and thus rotation of the rotatable input shaft of the building component when the body is secured to the rotatable input shaft of the building component via the securement;

the electronics operatively coupled to the motion sensor for receiving a motion sensor output signal from the motion sensor that is representative of rotation of the body; and the transmitter operatively coupled to the electronics for transmitting an output signal that is representative of rotation of the body.

2. The slippage detector of claim 1, wherein the securement includes a fastener that is configured to form an interference connection with the rotatable input shaft of the building component.

3. The slippage detector of claim 2, wherein the fastener comprises a screw, and the body includes threads for receiving the screw.

4. The slippage detector of claim 1, wherein the body includes an aperture that is configured to allow the rotatable input shaft of the building component to pass through the aperture of the body.

5. The slippage detector of claim 4, wherein the securement includes a fastener that is configured to form an interference connection with the rotatable input shaft of the building component.

6. The slippage detector of claim 5, wherein the fastener comprises a screw, and the body includes a threaded hole for receiving the screw such that the screw can extend into the aperture in the body and engage the rotatable input shaft of the building component.

7. The slippage detector of claim 4, wherein the body comprises an annulus shaped cross-section.

8. The slippage detector of claim 1, wherein the motion sensor comprises a Micro-Electro-Mechanical System (MEMS).

9. The slippage detector of claim 1, wherein the motion sensor comprises a gyroscope.

10. The slippage detector of claim 1, wherein the motion sensor comprises an accelerometer.

11. The slippage detector of claim 1, wherein the motion sensor comprises a magnetic field sensor.

12. The slippage detector of claim 1, wherein the building component comprises a damper with a rotatable damper input shaft.

13. The slippage detector of claim 1, wherein the building component comprises a water valve with a rotatable valve input shaft.

14. The slippage detector of claim 1, wherein the transmitter comprises a wireless transmitter for transmitting the output signal that is representative of rotation of the body.

15. The slippage detector of claim 14, wherein the wireless transmitter comprises a near field transmitter for supporting Near Field Communication (NFC).

16. The slippage detector of claim 1, further comprising a wireless receiver for wirelessly receiving energy to power the motion sensor, the electronics and the transmitter.

17. An actuatable building control component, comprising:

an actuatable building control component that includes a rotatable input shaft;

an actuator having a rotatable output that is releasably coupled to the rotatable input shaft of the actuatable building control component, the actuator is configured to rotate the rotatable output of the actuator on command to rotate the rotatable input shaft of the actuatable building control component; and a slippage detector that is separate from the actuator, the slippage detector is removably fixed to the rotatable input shaft of the actuatable building control component, wherein the slippage detector is configured to send information regarding a detected rotation of the slippage detector and thus rotation of the rotatable input shaft of the actuatable building control component to a receiver of the actuator.

18. The actuatable building control component of claim 17, wherein the actuator is configured to use the information regarding the rotation of the slippage detector and thus the rotation of the rotatable input shaft of the actuatable building control component received from the slippage detector, along with a known motion of the rotatable output, to determine when there is a slippage between the rotatable output of the actuator and the rotatable input shaft of the actuatable building control component.

19. The actuatable building control component of claim 18, wherein the actuator transmits an alert when the actuator detects the slippage.

20. A method for detecting a slippage in a connection between a rotatable output of an actuator and a rotatable input shaft of an actuatable building control component, the method comprising:

sensing a rotation of the rotatable input shaft of the actuatable building control component via a slippage detector that is mounted to the rotatable input shaft of the actuatable building control component, the slippage detector is separate from the actuator;

transmitting the sensed rotation of the rotatable input shaft of the actuatable building control component to the actuator;

comparing the sensed rotation of the rotatable input shaft of the actuatable building control component to the rotation of the rotatable output of the actuator; and providing an alert when the sensed rotation of the rotatable input shaft of the actuatable building control component deviates from the rotation of the rotatable output of the actuator by a threshold amount.

* * * * *